United States Patent [19]

Muck et al.

[11] Patent Number: 5,014,976

[45] Date of Patent: May 14, 1991

[54] EXIT ROLLER SHIELD FOR DUPLEX PRINTING

[75] Inventors: Dennis N. Muck, Walworth; Dennis M. Ankrom, Williamson; George B. Brown, Fairport, all of N.Y.

[73] Assignee: Xerox Corporation, Stamford, Conn.

[21] Appl. No.: 504,366

[22] Filed: Apr. 4, 1990

[51] Int. Cl.[5] ..... B65H 31/26

[52] U.S. Cl. ..... 271/220; 271/902

[58] Field of Search ..... 355/317-321, 355/322; 271/225, 184, 902, 220

[56] References Cited

U.S. PATENT DOCUMENTS 3,847,388 11/1974 Lynch ..... 271/220 X 4,916,493 4/1990 DeVito ..... 355/321

*Primary Examiner*—Richard A. Schacher

[57] ABSTRACT

In a reproduction apparatus outputting copy sheets via exit rollers to be stacked in an adjacent stacking tray, which exit rollers are also reversible to feed a selected copy sheet still in the nip back into the reproduction apparatus to be further processed, the previously outputted and stacking copy sheets are prevented from being recaptured by these reversed rotation exit rollers, by automatically interposing a one-way gate or trap and baffle between the stacking copy sheets and the exit rollers, to prevent accidental reacquisition of those sheets into the reversed rollers, but which gate or trap is automatically deflected out of the way of a sheet being outputted from the nip of the exit rollers by the outputted sheet itself, without requiring any other actuating mechanism. Preferably this is a deflectable portion of a unitary shield member, with a sheet edge catching lip on top thereof positioned and adapted to ride against the bottom of the selected sheet being reverse fed, to catch the edge of, and deflect into an integral concave sheet edge trap, any other sheet being dragged back with the selected sheet towards the nip of the rollers. Preferably an arcuate baffle portion also extends outside of the periphery of the bottom exit roller, which may also be so deflectable.

13 Claims, 2 Drawing Sheets

EXIT ROLLER SHIELD FOR DUPLEX PRINTING

Figure 1:
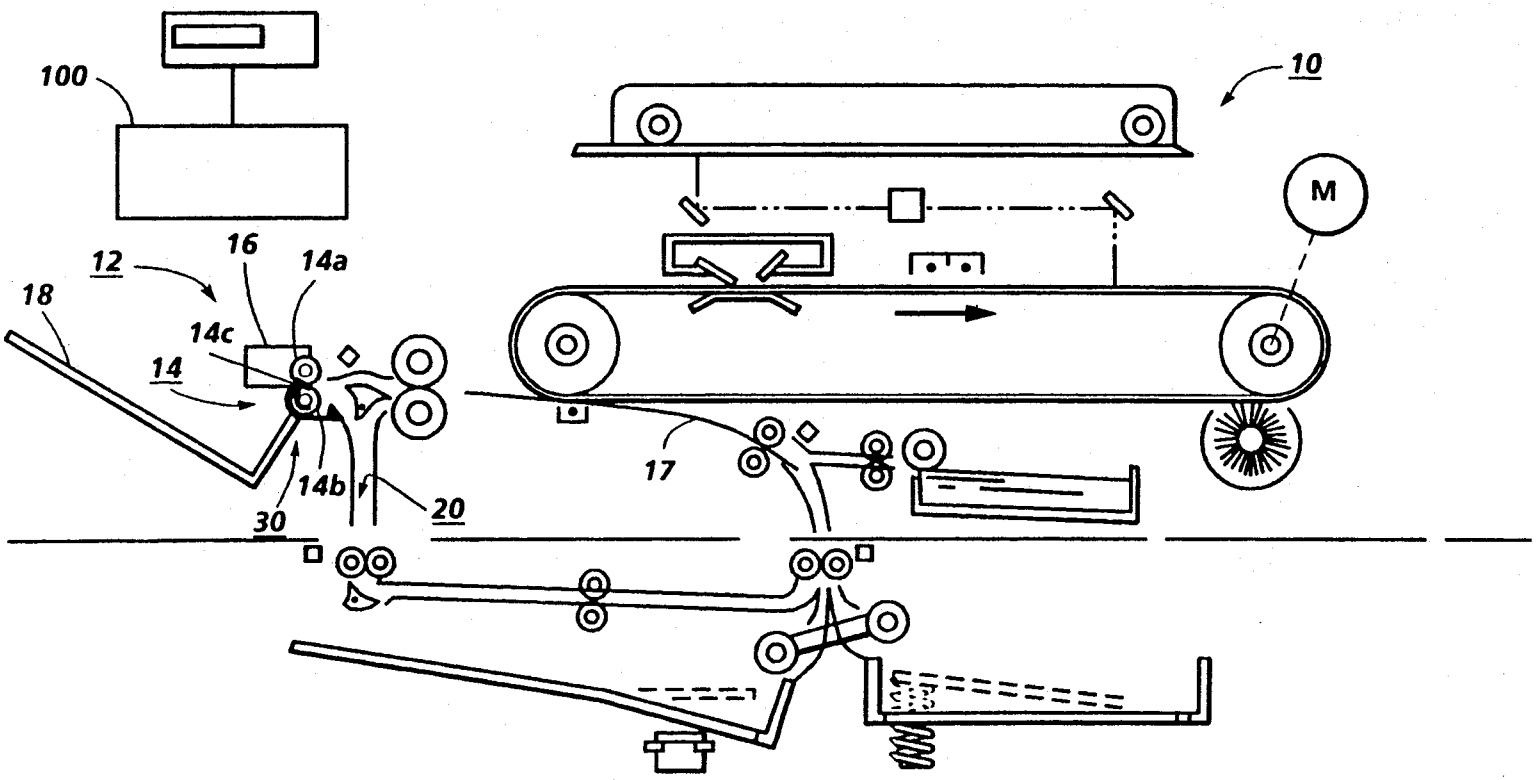

This invention is an improvement over U.S. Pat. No. 4,916,493 a copending U.S. app. Ser. No. 07/398,117 by the same assignee filed Aug. 24, 1989 by G. M. DeVito entitled Exit Roller Reversal Gate for Duplex Printing, attorney docket No. D/89004, which is hereby cross-referenced and incorporated by reference.

The disclosed invention is particularly applicable to known, desirable, systems in copiers or printers for printing copy sheets from optical or electronic page information utilizing reversible, dual mode, copy sheet rollers. In particular, there is disclosed a simple and low cost system for automatically interposing gate, shield or baffle means to prevent accidental reacquisition of sheets previously fed from sheet rollers when the rollers are reversed.

The disclosed system automatically prevents previously ejected and stacking copy sheets from being recaptured by reversed rotation sheet ejection rollers, yet does not interfere with normal sheet feeding. Inadvertently pulling previously exited sheets back into the machine can cause paper jams, etc.

This disclosed system has particular utility in cooperation with copy sheet exit rollers which normally eject copy sheets into adjacent copy sheet tray or sorter bins for stacking, but which rollers are also reversible with a sheet still in their nip to return selected copy sheets into a duplex path with inversion for second side copying, or for second pass same side overprinting such as for highlight color. The system disclosed here addresses a general problem of various such (now-popular) reversible roller dual mode output stacker/duplexing systems. That is, the tendency to inadvertently re-feed or reacquire the last previously outputted ejected finished duplexed copy sheet when the output rollers are reversed with a simplexed sheet in their nip for the return of that simplexed sheet for its duplexing. More specifically, this system positively stops finished duplex copies previously deposited in the exit stacking tray or sorter bins from being pulled back into the processor via the exit rollers when the exit roll drive reverses to reverse feed a simplex copy into a secondary paper path for duplex operation.

The disclosed system provides a cheaper and simpler solution than the above cross-referenced Exit Roller Reversal Gate for Duplex Printing application Ser. No. 07/398,117 system, now U.S. Pat. No. 4,916,493. That system requires an active, mechanically driven, pusher system, thereby requiring a drive system, and does not insure positive trapping or stop gating of a sheet attracted back into the reversed roller nip. In contrast, in the present system a simple shield member is simply deflected by the paper sheet itself with any mechanical drive connection or system.

Referring to the disclosed embodiment, it may be seen that the above and other desired objectives can be achieved in a reproduction apparatus outputting copy sheets via exit rollers to be stacked in an adjacent stacking tray, which exit rollers are also reversible to feed a selected copy sheet still in the nip back into the reproduction apparatus to be further processed, by the previously outputted and stacking copy sheets being prevented from being recaptured by these reversed rotation exit rollers, by automatically interposing a one-way gate or trap and baffle between the stacking copy sheets and the exit rollers, to prevent accidental reacquisition of those sheets into the reversed rollers, but which gate or trap is automatically deflected out of the way of a sheet being outputted from the nip of the exit rollers by the outputted sheet itself, without requiring any other actuating mechanism.

Preferably, as in the disclosed embodiment example, this one-way gate or trap is a deflectable portion of a unitary shield member, with a sheet edge catching lip on top thereof positioned and adapted to ride against the bottom of the selected sheet being reverse fed, to catch the edge of, and deflect into an integral concave sheet edge trap, any other sheet being dragged back with the selected sheet towards the nip of the rollers. Preferably an arcuate baffle portion also extends outside of the periphery of the bottom exit roller, which may also be deflectable.

The disclosed system allows unobstructed sheet exiting and outward sheet movement through a sheet output nip of exit rollers, but captures or traps and retains the edge of any previously ejected sheet trying to feed back into the nip when the exit rollers rotation is reversed.

By way of further background in the above-noted duplexing or other second pass copying systems in which the present system is disclosed, providing a simple integrated copy sheet output and optional copy sheet return path, one example is shown and described in U.S. Pat. No. 4,708,462 noted below, and there are various others. The system disclosed herein is usable with various other types of duplexing or other second pass copying systems. These may be with trayless buffer loops, or with copy sheet stacking and refeeding from a buffer tray between the first and second copying (image transfer) operations, or a combination thereof. These systems are know in the published art.

Said Xerox Corporation U.S. Pat. No. 4,708,462 issued Nov. 24, 1987 to D. J. Stemmle, and art cited therein, is of interest as the herein-disclosed example of a duplexing path copier with a dual mode inverter/output path feeder system with reversing exit rolls, for a choice of simplex or duplex copying, with which the present invention may be very effectively combined and utilized, as shown herein. Said U.S. Pat. No. 4,708,462 to D. J. Stemmle also discloses an optional path choice of a trayless duplex loop path extending over and bypassing a duplex buffer tray.

Also noted is U.S. Pat. No. 4,660,963 issued Apr. 28, 1987 to D. J. Stemmle, and art cited therein. Other patent examples of duplexing copiers with duplexing paths including reversible sheet output rollers functioning as sheet inverters include Canon Sasaki et al U.S. Pat. No. 4,787,616, and Ricoh Tsujihara U.S. Pat. No. 4,692,020. U.S. Pat. No. 4,348,101 issued Sept. 7, 1982 to A. Schonfeld, et al (Sperry Corporation), shows a duplex laser printer with somewhat similar output and inverting paths. Reversing duplex printing operation is also shown in U.S. Pat. No. 4,699,503 to Hyloft.

Other references of background interest in said above cross-referenced app. Ser. No. 07/398,117 include Graef U.S. Pat. No. 4,494,747 re selectively camming a fence 35 against a stack of sheets during a portion of the machine cycle in a currency dispenser to insure that the sheets are not picked up by the fed roll (see especially sheet 5 and Col. 7). To a similar effect are Van Dalen U.S. Pat. No. 3,108,801 and Binzoni et al U.S. Pat. No. 3,173,684. Xerox Corp. U.S. Pat. No. 4,493,483 to Teumer et al, and IBM TDB Vol. 20, No. 1, June 1977, page 22, by Bullock, show examples of a sheet reverser with a buckle control or kicker plate to insure feeding of a sheet being reversed into the correct nip.

Further specific features of the invention are set forth in the accompanying claims, individually or in combination.

All references cited in this specification, and their references, are incorporated by reference herein where appropriate for appropriate teachings of additional or alternative details, features, and/or technical background.

Figure 2:
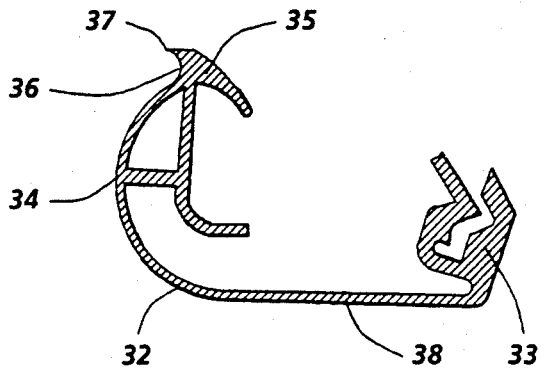
Figure 3:
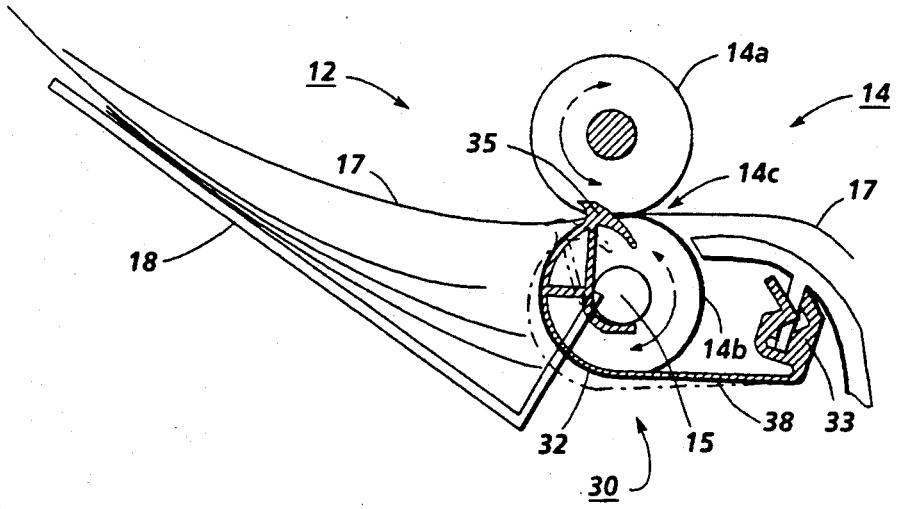

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

FIG. 1 is a schematic side view of one example of a duplex copier incorporating the exit roller reversal gate system of the invention;

FIG. 2 is an enlarged separate piece-part side view of one of the subject unitary reversal gate members of the embodiment of FIG. 1; and FIG. 3 is an enlarged portion of FIG. 1 showing the exit rollers and reversal gate portion of the embodiment of FIG. 1, with the two operating positions of the exemplary exit roller gate member of FIG. 2 (and a sheet in the nip) shown in solid and phantom lines, respectively, with respective movement arrows.

With reference to the above-noted Figures, there is shown in FIG. 1 a duplex copier or printer 10 merely by way of one example of an duplex electrostatographic reproducing machine of a type suitable to utilize the system of the present invention. While the machine 10 is exemplified here as an electrostatographic copier, other types of reproducing machines or apparatus such as laser or ink jet printers, etc., may be envisioned. Although the present system is particularly well adapted for use in such compact copiers or printers, it will be evident from the following description that it is equally well suited for use in a wide variety of reproduction systems and is not limited in application to the particular embodiment shown herein. The FIG. 1 illustrated duplex copier 10 per se is that shown and described in the above-cited U.S. Pat. No. 4,708,462, and elsewhere, and thus need not be redescribed herein. Thus, the following description relates only to the subject copy sheet output path portion 12 of the copier 10, shown in more detail in the other Figures.

The subject copy sheet output path portion 12 particularly includes two mating or nipped sets of copy sheet output path or exit rollers 14. The rollers 14 comprise a lower set of rollers **14*b* on an axially movable as well as rotatable shaft 15, and upper rollers 14*a*, defining a nip 14*c* therebetween. One said set of the rollers 14 are selectably reversibly driven by a reversible drive 16**. The other roller set may, conventionally, be idlers.

The rollers 14 normal continue rotating in one direction to feed and drive the sheets 17 downstream to eject the sheets out of this exit nip **14*c* to be stacked into output tray 18 (a fixed single tray or or any selected sorter bin tray). However, for duplexing copy sheets, the rollers 14 are reversed while a copy sheet 17 only printed on one side (simplexed) is still in the roller nip 14*c*, to transport those copy sheets back into a duplex path 20. That is, for returning those copy sheets to the copy processor with inversion be imaged on their opposite sides to make duplex copies, as shown in FIG. 1. This is taught by the above-cited and other references, particularly the U.S. Pat. No. 4,708,462 embodiment disclosed here. As shown, this sheet reversing for inverting function is integral the normal sheet exit transport and paper path, and is implemented by reversal of rollers 14 and thereby reversal of a selected sheet 17 still in the nip 14*c* thereof. The simplexed sheet 17 to be duplexed may be stopped in the nip 14*c* at a point, for example, only approximately 15 mm prior to its trail edge exiting the nip. Thus a substantial portion of the simplexed sheet is already hanging out of the nip into the tray 18** area, and upon the motion reversal of that sheet it tends to pull other, completed and previously outputted, sheets back into the nip with it. The system here prevents that.

When the actual output of a completed duplexed copy sheet is desired, the rollers 14 simply continue to rotate in the same forward or downstream feeding direction until the sheet is fully ejected from the rollers 14 nip **14*c***, instead of reversing after only part of the sheet is extending therefrom.

Turning now to the disclosed reversal gate system 30 for automatically interposing a sheet trapping gate, guide or baffle member to prevent accidental reacquisition of copy sheets by the reversed rollers 14, this is embodied here by a plurality of simple unitary or monolithic partially flexible plastic shield members 32. That is, preferably a plurality of identical simple unitary plastic members 32 fastened spaced transversely across the sheet exit roller 14 area. Each disclosed unitary member 32 shown here is cantilever mounted from a snap-on mounting portion 33 at one end thereof, and has: (a) an arcuate roller shield portion 34 normally extending slightly beyond the radius of the bottom exit rollers **14*b*. The outer end thereof comprises (b) a "beak" shaped deflectable portion 35 normally positioned in front of the downstream sheet exit path, adjacent the nip 14*c* outlet of the exit roller 14 paper path, which deflectable portion 35 includes a specially concave shaped integral reverse sheet feeding trap 36, and a communicating sheet edge catching lip 37. The entire deflectable portion 35 (and its connecting shield portion 34) is deflectable by an exiting sheet lead edge by its cantilevered mounting on (c) an integral intermediate spring portion (thin section) 38 between it and the snap-on mounting portion 33. This deflectable unitary member 32 allows normal sheet exiting and outward sheet movement through the nip 14*c*** but can capture or trap and retain the trail edge of any previously ejected sheet trying to feed back into the nip.

To express this in other words, the reproduction apparatus 10 is normally outputting copy sheets via exit rollers 14 to be stacked in the adjacent stacking tray 18, but these exit rollers 14 are intermittently reversed to feed a selected copy sheet 17 still in the nip **14*c* back into the reproduction apparatus 10 to be further processed. But the previously outputted and stacking copy sheets are prevented from being recaptured by these reversed rotation exit rollers 14, by automatically interposing the disclosed one-way gate or trap and baffle provided between the stacking copy sheets and the exit rollers provided by the deflectable portion 35 of one, or preferably more, unitary members 32, to prevent accidental reacquisition of those sheets into the reversed rollers 14. Yet here that one-way gate or trap is automatically deflected out of the way of a sheet being outputted from the nip 14*c* of the exit rollers by the force of outputted sheet itself, without requiring any other actuating mechanism. That deflection is downwardly, and also outwardly or downstream by, e.g., 5 mm or so, until it is pushed out of the way below the sheet being outputted. This is shown by the dotted line position in FIG. 3. The "beak" upper surface can be deflected from the initial angle shown extending vertically across the nip sheet exit path to an almost horizontal position. That movement causes the downstream side of the deflectable portion 35 to push downstream and downwardly any previously ejected sheets in its deflection path. As shown, here the arcuate baffle or shield portion 34 is also deflected further outside of the periphery of the bottom exit roller 14*b*** by this same deflection, to push away sheets being stacked.

This deflectable portion 35 of the unitary member 32 has its sheet edge catching lip 37 on top thereof positioned and adapted to ride with upward spring force (from spring portion 38) directly against the bottom of the selected simplex sheet 17 being reverse fed, so as to to catch the edge of, and deflect into the integral concave sheet edge trap 36 (of which it is an surface extension), any other sheet being dragged back with the reverse-moving sheet towards the nip **14*c* of the rollers 14. That is, the lip 37 acts as a sheet stripping finger. Once a sheet edge is caught in this concave surface area 36 that sheet cannot be dragged back into the nip, but it can freely drop or be pushed by the next outputted sheet into the tray 18**.

The disclosed system 30 positively traps, pushes away and holds away the rear edges of previously ejected sheets from the roller nip **14*c* and the lower rollers 14*b*, and thus providing an active gate to prevent those sheets already in the exit tray 18 area from being engaged, picked up and fed back into the nip of rollers 14. That overcomes a particular problem with copy sheets with fluff or curl, which tends to cause their rear edges to engage the rollers 14*b*, the surfaces of which are moving upwardly and into the nip when the rollers 14** are reversed.

As is well known in the art, to control the operation of the reproducing machine 10, including the reversible rollers 14, a suitable programmable controller 100 and a connecting control panel is preferably conventionally provided. Conventional and/or readily programmable software microprocessor or other electronic controls may be used for controlling all machine and paper path operations and sensing.

While the embodiment disclosed herein is preferred, it will be appreciated from this teaching that various alternatives, modifications, variations or improvements therein may be made by those skilled in the art, which are intended to be encompassed by the following claims:

We claim:

1. In a reproduction apparatus with means for outputting copy sheets via nipped exit rollers and stacking the outputted copy sheets adjacent said exit rollers in a stacking tray, which exit rollers are reversible in their direction of rotation to feed selected sheets back into said reproduction apparatus in a return path via the nip of said exit rollers before the selected sheet is outputted, the improvement comprising;

automatic gate means for preventing previously outputted copy sheets from being recaptured by said reversed rotation exit rollers including sheet edge trapping means intermittently interposed adjacent the nip of said nipped exit rollers between the outputted sheets in said stacking tray and said nip of said exit rollers for preventing reacquisition of outputted copy sheets by said reversed rotation exit rollers, said sheet edge trapping means being automatically pushed out of the way of a sheet being outputted from the nip of said nipped exit rollers by the outputted sheet itself.

2. The reproduction apparatus of claim 1, wherein said automatic gate means additionally comprises an arcuate shield portion closely adjacent said exit rollers but arcuately extending around and radially outside of the periphery of the lowermost of said exit rollers on the side thereof facing towards said stacking tray to restrain contact of outputted copy sheets with said periphery of the lowermost of said exit rollers.

3. The reproduction apparatus of claim 1, wherein said automatic gate means is a plurality of unitary component members spaced transversely across said means for outputting copy sheets closely adjacent said exit rollers, with each said unitary component member having a resilient portion flexibly mounting said sheet edge trapping means.

4. The reproduction apparatus of claim 1, wherein said sheet edge trapping means comprises a small concave surface on said automatic gate means facing towards said stacking tray and away from said nip of said exit rollers and positioned to catch the lead edge of previously outputted sheet attempting to reverse feed back into said nip of said exit rollers.

5. The reproduction apparatus of claim 2, wherein said automatic gate means is a plurality of unitary component shield members spaced transversely across said means for outputting copy sheets closely adjacent said exit rollers, with each said unitary component member having a resilient portion flexibly mounting said sheet edge trapping means.

6. The reproduction apparatus of claim 5, wherein said unitary shield member is a monolithic plastic molding.

7. The reproduction apparatus of claim 1, wherein said sheet edge trapping means further comprises a deflectable beak portion closely adjacent to and facing said nip of said exit rollers and flexibly mounted to said automatic gate means for said being automatically pushed out of the way of a sheet being outputted from the nip of said nipped exit rollers by the outputted sheet itself.

8. The reproduction apparatus of claim 1, wherein said automatic gate means is a unitary member additionally comprising an arcuate shield portion arcuately extending around the periphery of the lowermost of said exit rollers on the side thereof facing towards said stacking tray to restrain contact of outputted copy sheets with said periphery of the lowermost of said exit rollers; and wherein said sheet edge trapping means comprises a deflectable portion of said unitary member closely adjacent to and in the sheet output path of said nip of said exit rollers and flexibly mounted to be automatically deflected by said being pushed out of the way of a sheet being outputted from the nip of said nipped exit rollers by the outputted sheet itself; and wherein said deflection of said deflectable portion also moves said arcuate shield portion away from said lowermost of said exit rollers when said deflectable portion is deflected by a sheet being outputted from the nip of said nipped exit rollers.

9. The reproduction apparatus of claim 8, wherein said sheet edge trapping means comprises a concave sheet edge trapping surface on said deflectable portion of said unitary member, terminating in an upper sheet edge catching lip, facing towards said stacking tray and facing away from said nip of said exit rollers, and positioned to catch the trail edge of previously outputted sheet attempting to reverse feed back into said nip of said exit rollers.

10. The reproduction apparatus of claim 9, wherein said unitary shield member is a monolithic plastic molding.

11. The reproduction apparatus of claim 9, wherein said upper sheet edge catching lip on said deflectable portion of said unitary member is positioned and adapted to ride against the bottom surface of a said selected sheet being fed back into said reproduction apparatus by said reversible exit rollers and to catch the edge of and deflect into said concave sheet edge trapping surface any other sheet being fed with said selected sheet towards said nip of said exit rollers.

12. The reproduction apparatus of claim 9, wherein said deflectable portion of said unitary member providing said sheet edge trapping means is a downwardly pointed beak shaped portion facing towards said nip of said exit rollers with said concave sheet edge trapping surface forming the rear surface thereof and extending to the uppermost surface thereof to define said upper sheet edge catching lip.

13. The reproduction apparatus of claim 1, wherein said sheet edge trapping means comprises an upper sheet edge catching lip on a sheet deflectable element positioned and adapted to ride against the bottom surface of a said selected sheet being fed back into said reproduction apparatus by said reversible exit rollers and to catch the edge of, and deflect away, any other sheet being fed with said selected sheet towards said nip of said exit rollers.

* * * * *